US005224569A

United States Patent [19]

Hewitt et al.

[11] Patent Number: 5,224,569

[45] Date of Patent: Jul. 6, 1993

[54] BOAT LIFT WITH ARTICULATING ARM

[75] Inventors: Larry L. Hewitt, 706 Ash Box 111, Nicollet, Minn. 56074; Donald W. Hewitt, Roseville, Minn.

[73] Assignee: Larry L. Hewitt, Nicollet, Minn.

[21] Appl. No.: 710,152

[22] Filed: Jun. 4, 1991

[51] Int. Cl.[5] ..... B66F 7/02

[52] U.S. Cl. ..... 187/27; 187/8.59; 254/285; 254/387

[58] Field of Search ..... 187/8.59, 27; 254/284, 254/285, 358, 387

[56] References Cited

U.S. PATENT DOCUMENTS

| | | | |
|---|---|---|---|
| Re. 32,118 | 4/1986 | Godbersen | 187/8.59 X |
| 3,139,266 | 6/1964 | Tew | 187/8.59 X |
| 3,284,052 | 11/1966 | Godbersen | 187/11 X |
| 4,109,896 | 8/1978 | Ragen | 187/859 X |

FOREIGN PATENT DOCUMENTS

| | | | |
|---|---|---|---|
| 793679 | 1/1936 | France | 187/8.59 |
| 2-239100 | 9/1990 | Japan | 187/8.59 |

*Primary Examiner*—Michael S. Huppert
*Assistant Examiner*—Janice Krizek
*Attorney, Agent, or Firm*—Douglas L. Tschida

[57] ABSTRACT

A boat support framework including an elevating cradle supported between a plurality of cable and pulley containing lift towers via a plurality of roller bearings in engagement therewith. A cable take up axle includes separate cable drums and cables to each lift tower and is controlled from a handwheel or winch operated articulating drive arm and multiple endless chains coupled therebetween. Hinged frameworks pivotally coupled to cross frame members of a base frame and the cradle articulate to support the cradle over the range of lift travel.

21 Claims, 7 Drawing Sheets

BOAT LIFT WITH ARTICULATING ARM

BACKGROUND OF THE INVENTION

The present invention relates to boat cradles and, in particular, to an elevating hoist and storage assembly.

Varieties of boat storage assemblies have been developed over the years for variously supporting the hull of a boat when in dry dock or when moored in the water. For example, the boat may be moored to the stationary dock, but which subjects the boat to wave action and requires the mounting of resilient bumpers to the dock to prevent damaging the boat or dock. A mooring buoy may also be anchored at a point removed from the dock, which permits the boat to move freely with water action. However, a separate boat is then required to access the moored boat.

Some assemblies preferred by many boat owners maintain the boat in a stationary mooring, such as adjacent a dock, for ready access by the owner/operator. In so doing the boat is suspended above the water and potentially harmful wave action. Thus a variety of hoists or elevating cradle assemblies have been developed.

Most such assemblies provide a framework including a number of vertical columns and relative to which a cradle support is elevationally mounted. The cradle typically is raised and lowered via a handwheel driven chain or cable linkage coupled to the cradle. Intermediate pulleys or sprockets appropriately direct the linkage to apply desired lifting/lowering forces. The present Assignee has for many years sold steel and aluminum, boat and pontoon lifts which use single cable lift arrangements and a pair of slide columns.

Applicant is otherwise aware of a two-column assembly shown in U.S. Pat. No. 3,284,052. Four column assemblies are shown in U.S. Pat. Nos. 3,275,167 and 4,401,335.

While the foregoing assemblies provide many conveniences to most boat owner/operators, the lift capacity of such assemblies has been limited to waters of relatively constant levels. Rivers and many impoundment areas, however, are subject to relatively wide fluctuations in water depth on a seasonal basis. Under some conditions, the water depth may even vary a matter of feet over the course of a single or several days or weeks.

It is with the latter types of waterways in mind that the present improved lift assembly was developed. This assembly not only accommodates wide depth fluctuations, but also is capable of supporting weight capacities from 3,000 to 8,000 pounds.

SUMMARY OF THE INVENTION

It is accordingly a primary object of the present invention to provide a stationary mooring assembly having an elevating cradle.

It is a further object of the invention to provide an assembly which accommodates a relatively wide range of elevation adjustments.

It is a further object of the invention to provide an assembly which transfers lift forces equally to all points of the lift assembly.

It is a further object of the invention to provide a cabled lift assembly, wherein the cables are supported from an axle containing cable take-up drums and a number of pulley containing lift towers.

It is a further object of the invention to provide a lift assembly including a handwheel driven, sprocketed drive chain means including a number of endless drive chains.

It is a further object of the invention to support the drive chain means from an articulating frame arm coupled between the handwheel and the cable drum axle.

It is a further object of the invention to provide a lift assembly including articulating support frame portions which couple the cradle to a base support frame and rise and fall with the varying cradle elevations.

It is a further object of the invention to provide auxiliary frame extension means, a canopy means and powered winch capabilities.

Various of the foregoing objects, advantages and distinctions of the invention are particularly achieved in one presently preferred construction. This construction includes a welded metal framework, such as aluminum or corrosion treated steel, having four, vertical lift towers or columns which are secured in predefined rectangular relation to one another and which can be leveled via a like number of leveling jacks or column extensions. A boat support cradle includes a pair of cross frame members which are slidably constrained between the fore and aft pairs of vertical columns. A pair of longitudinal frame members couple the cross members to one another. Each cross member contains a variety of hull supports, keel protector pads, guide-on bumpers and other accessories. A cover or canopy mounts to the upper ends of the columns.

The cross frame members are slidably coupled to the lift columns and vertically supported from beneath via first and second hinge frames which pivotally extend from the base frame. First and second pairs of cables mounted to axle supported cable take-up drums are trained about a plurality of pulleys at the lift columns to support the cradle to the framework from above. A handwheel is rotatively coupled to the axle via a plurality of sprockets, drive chains and an articulating framework. The drive chains control the cradle elevation and articulate with respect to movement thereof. In lieu of a handwheel a remotely powered winch can be coupled to the axle.

Still other objects, advantages and distinctions of the invention will become more apparent from the following detailed description with respect to the appended drawings. A presently preferred construction, along with variously considered modifications and improvements thereto are particularly described. The description, however, is intended to be illustrative only and the invention should not be interpreted in strict limitation thereto. Rather, the invention should be interpreted within the scope of the following appended claims.

DESCRIPTION OF THE PREFERRED EMBODIMENT

Figure 1:
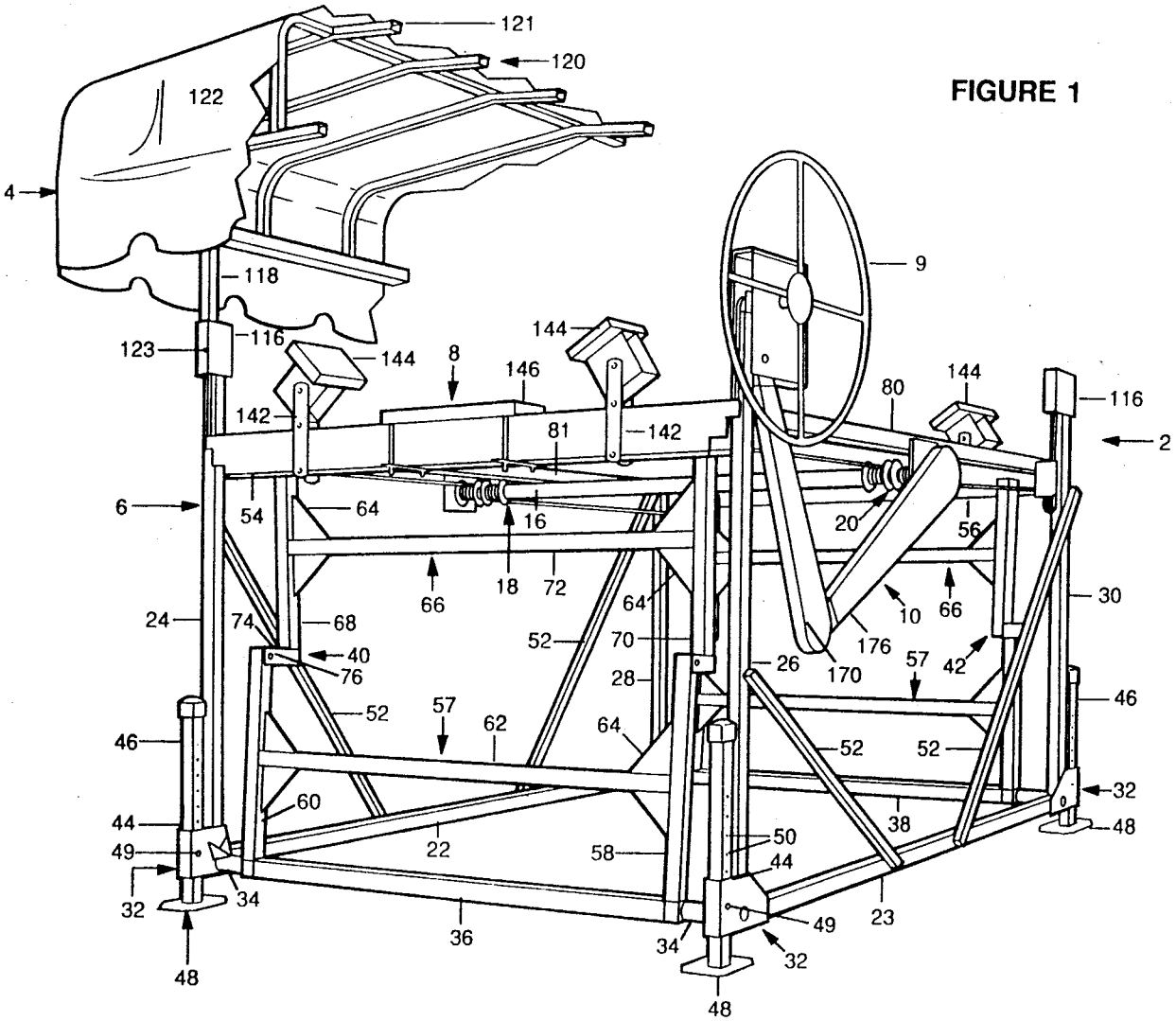
FIG. 1 is a perspective assembly drawing of the boat lift of the invention, wherein the assembly is shown in its raised condition and in partial cutaway.
Figure 2:
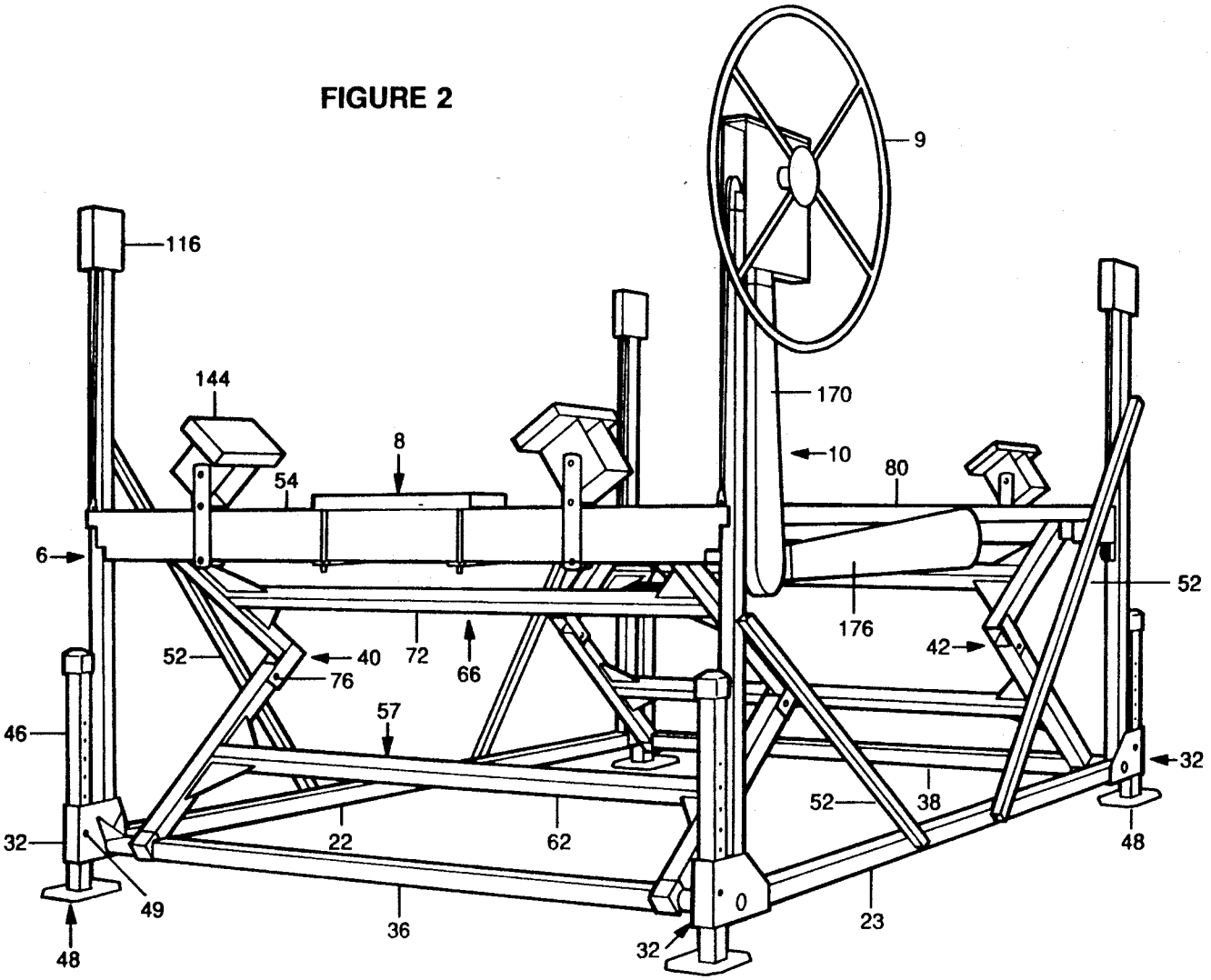
FIG. 2 is a perspective drawing of the boat lift assembly shown in a partially lowered condition.
Figure 3:
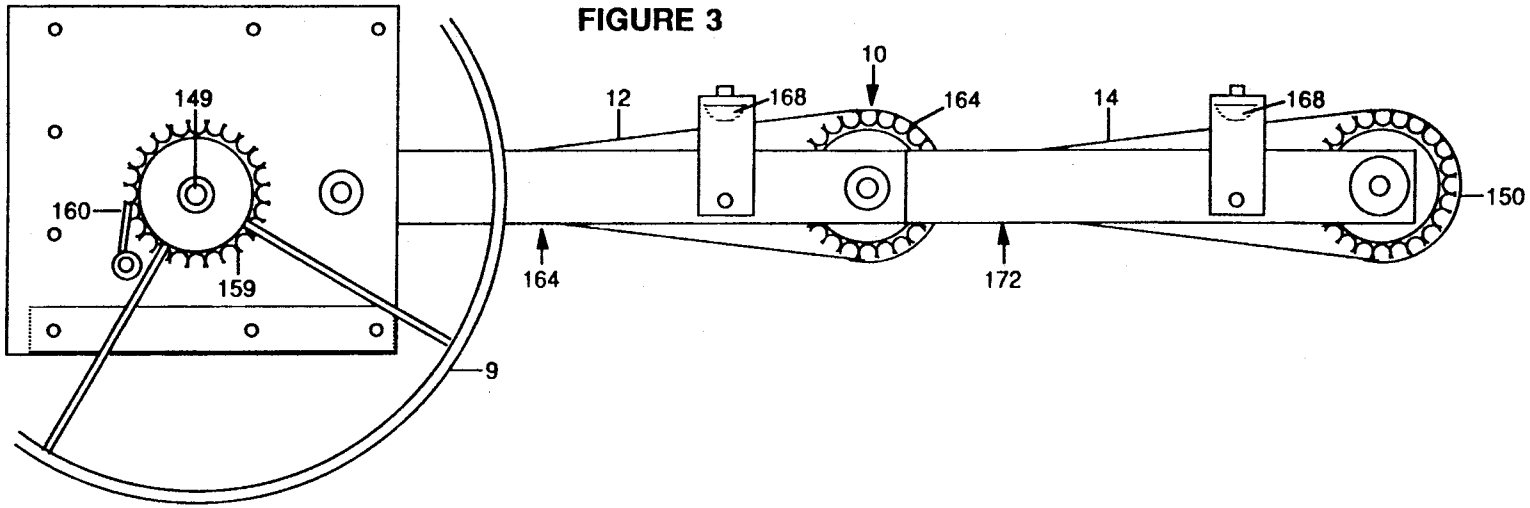
FIG. 3 is a front elevation drawing of the handwheel and articulating drive arm assemblies with the safety shrouds removed.
Figure 4:
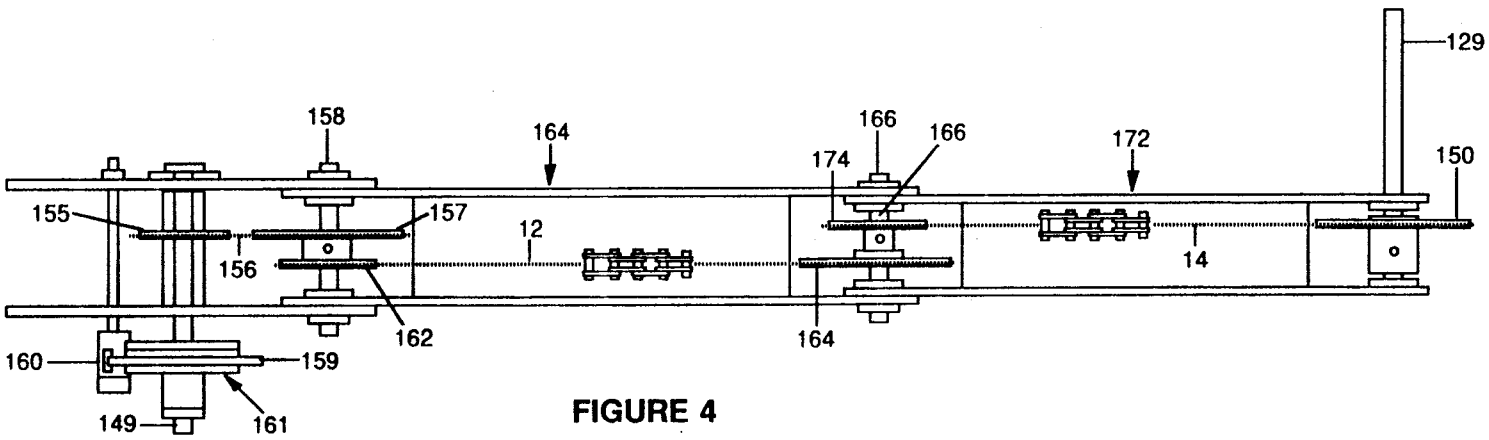
FIG. 4 is a top plan view of FIG. 3.

With attention to FIGS. 1 and 2, assembled perspective drawings are shown of a manually controlled version of the boat lift assembly 2 of the present invention. FIG. 1 depicts the assembly in a raised condition and FIG. 2 depicts the assembly in a partially lowered condition. An appreciation can be obtained therefrom of the cooperation between articulating hinged support frames 40, 42 and an articulating chain driven, lift arm assembly 10, which is shown in detail in FIGS. 3 and 4. Shown also in partial cutaway of FIG. 1 is an overlying cover or shade canopy 4.

The assembly 2 comprises a welded and bolted framework of structural aluminum members and can be variously configured in different models to support weight capacities ranging from 3,000 to 8,000 pounds. Common to all constructions is a base framework 6 and to which a separate boat support framework or cradle 8 is slidably constrained. The elevation of the cradle 8 is controlled via a handwheel 9 and the articulating lift arm 10 which supports a pair of endless drive chains 12 and 14 (reference FIGS. 3 and 4) in relation to a drive axle 16 and a pair of spooled cable drum assemblies 18 and 20. The assembly 2 is operative over a lift range of 2 to 6 feet and accommodates boats ranging from 20 to 30 feet in length over the foregoing weight capacities. It is to be appreciated, however, that with modification, larger or smaller boats can be accommodated.

The base framework 6 principally comprises a pair of longitudinal frame members 22, 23 which extend between four upright, vertical lift towers or columns 24, 26, 28 and 30, positioned at each corner of the framework 6. Projecting inward from a lower collar 32 of each column is a stub shaft 34. Pivotally mounted between opposite pairs of the stub shafts 34 are forward and aft cross frame members 36 and 38. The frame members 36, 38 define the lower end of a pair of framed hinge assemblies 40 and 42 that support the ends of the cradle 8.

A portion of each collar 32 defines a bore 44 wherein adjustable leveling or jack columns 46 are mounted. Each column 46 includes end support pads 48. A lynch pin or bolt fastener 49 mounts through each collar 32 and a selected aperture 50 at each jack column 46 to permit an adjustment of the initial elevation of the base frame 6.

Presently, the jack columns 46 accommodate an initial elevational adjustment of 2 feet. The hinge frames 40 and 42 and cradle 8 otherwise accommodate a further four feet of lift. Corner brace members 52 are coupled between the longitudinal frame members 22, 23 and the vertical columns 24, 26, 28, and 30.

The hinge frames 40 and 42 pivot at the fore and aft cross frame members 36, 38 to support fore and aft primary cross frame members 54, 56 of the cradle 8. Each hinge frame 40 and 42 includes a pair of wing portions 57, 66. The lower wing portion 57 provides right and left vertical uprights 58, 60. The uprights 58, 60 are spaced apart from one another via a cross member 62 which is welded thereto and supported via a plurality of triangular gussets 64. The upper wing portion 66 is similarly comprised of a pair of right and left uprights 68 and 70. The uprights 68, 70 are secured to each other via a cross member 72 and a plurality of welded triangular gussets 64.

Welded link arms 74 perpendicularly project between the lower end of the upper wing portions 66 and are secured to the upper ends of the lower wing portions 57 via pivot pins 76. A second pair of pivot pins and shackle brackets (not shown) secure the upper end of the wing portions 66 to the primary cross frame members 54, 56. The wing portions 57, 66 of each hinge frame 40, 42 thus pivot in an articulating fashion to support the cradle 8 as the cradle 8 travels up and down along the vertical columns 24, 26, 28 and 30.

Each cross frame member 54, 56 includes a pair of laterally mounted upright brackets 142 which are adjustable laterally along the members. Pivotally supported to each bracket 142 is a padded hull support 144. Also adjustably secured at the center of each cross member 54, 56 is a resilient keel support 146. Other supports, bumpers and the like may be mounted to the cradle 8 to facilitate guiding a boat on and off the cradle 8 or supporting a boat from the cradle 8.

Figure 5:
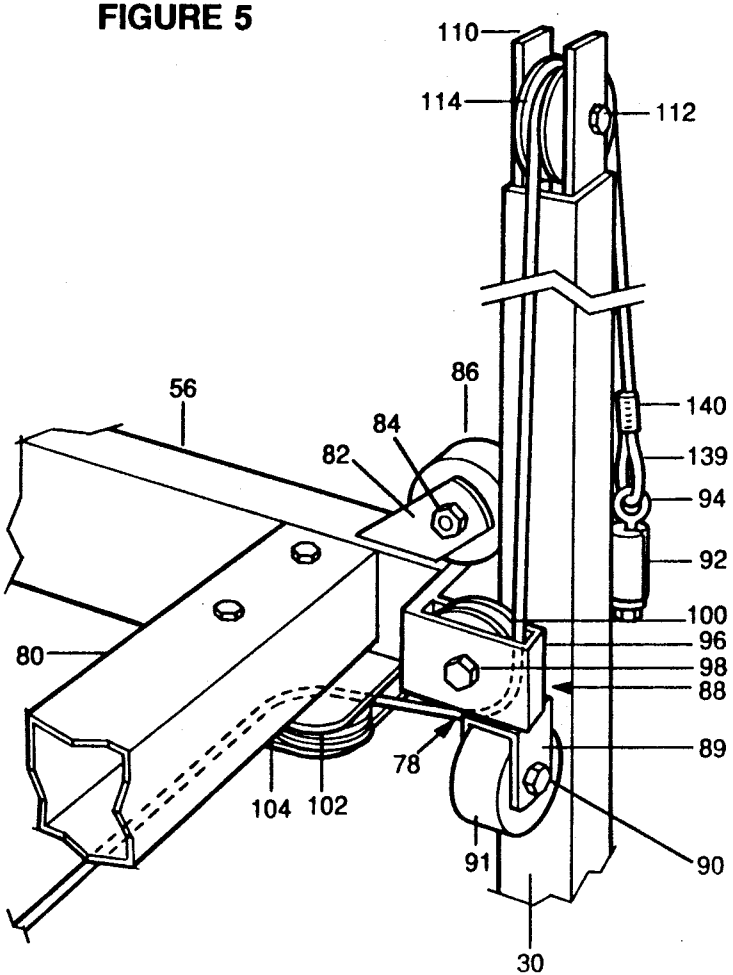
FIG. 5 is a perspective drawing of the coupling between one of the lift towers and a corner of the cradle.

With attention next directed to FIG. 5, slide coupler or bearing assemblies 78 are welded to the corners of the cradle 8 where the fore and aft cross frame members 54 and 56 mate with the longitudinal frame members 80, 81. The assemblies 78 constrain the cradle 8 to the lift columns 24, 26, 28 and 30. The assemblies 78 each include a pair of wheels or rollers which travel along the vertical columns in the fashion of roller bearings. A first roller 86 is supported from a pair of welded brace arms 82. A pivot pin 84 contains the roller 86 thereto and, in turn, mates with an inner lateral surface of one of the lift columns 24, 26, 28 or 30. The coupling to the lift column 30 is particularly depicted, although each coupling is identical.

An extruded aluminum yoke assembly 88 provides a pair of yoke portions. A first yoke portion 89 and pivot pin 90 support a second roller 91. The roller 91 mates with an inner longitudinal surface of each lift column. The rollers 86, 91 thus support the cradle 8 at each lift column along two inner surfaces of each column. The yoke 88, when viewed from above, also includes an end webb 92 which mounts adjacent the outer longitudinal surface of each lift column. The webb 92 prevents the cradle 8 from swinging fore and aft. Thus, the corners of the cradle 8 are supported at three surfaces of each column. A cable anchoring eyelet 94 also projects from the webb 92.

A second yoke portion 96 and pivot pin 98 supports a horizontal-to-vertical transition cable pulley 100. A horizontal pulley 102, which is tilted approximately sixty to seventy degrees from horizontal, is otherwise mounted inboard of the corner formed by the frame members 80, 56 and is supported between a pair of plates 104 by a pivot pin 106. Supported from the top of each lift column is a housing or pulley bracket 110 and a pivot pin 112 which contain a primary lift pulley 114 thereto. The pulleys 100, 102 and 114 thus direct the lift cables relative to each cradle corner and the lift columns.

Figure 11:
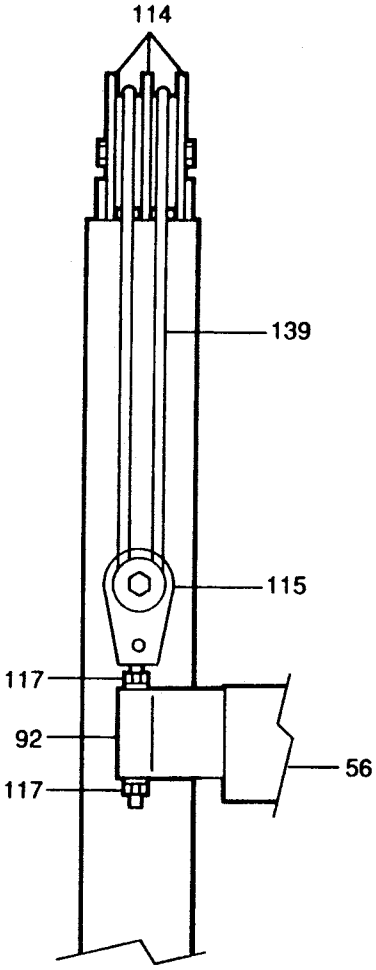
FIG. 11 is a front elevation drawing of the lift column of FIG. 10.
Figure 10:
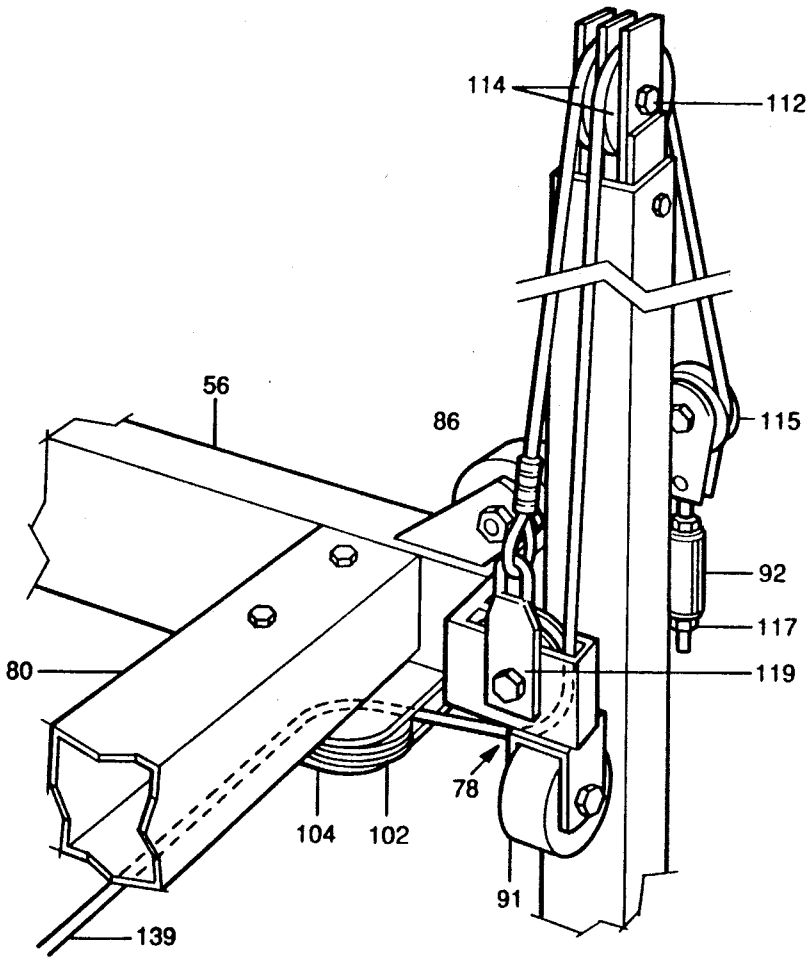
FIG. 10 is a perspective drawing of a multi-pulley lift column and corner pulley containing cradle.

FIGS. 10 and 11 depict an alternative lift column arrangement which finds advantage with boats weighing on the order of 8,000 pounds. The principal difference between this construction and that depicted at FIG. 5 is that a pair of pulleys 114 are mounted at each lift column and cooperate with a pulley 115 secured to the webb 92 and an anchor bolt 117. The cable 139, instead of being anchored to the webb 92, is directed through the pulley 115 and back through the second pulley 114 to an anchor bracket 119 secured to the second yoke 96.

Surrounding each bracket 110 is an outer shroud 116 (reference FIG. 1) which receives a vertical support column 118 of a canopy support framework 120. The overlying canopy 4 is shown in partial cutaway at FIG. 1. The canopy framework 120 includes a number of pitched, cross members 121 which project between outer longitudinal members (not shown).

The framework 120 particularly supports a correspondingly shaped, weather resistant fabric cover 122. Upon appropriately raising the cradle 8, a supported boat can be brought into close association to the cover 122 to protect the boat interior from rain, hail or other wind driven soil or the like. The mounting position of the canopy support framework 120 may be separately elevated or lowered relative to the shroud 116 upon appropriately positioning lynch pins or set screws 123 which contain the vertical support arms 118 to the shrouds 116 and lift columns 24, 26, 28 and 30.

Figure 8:
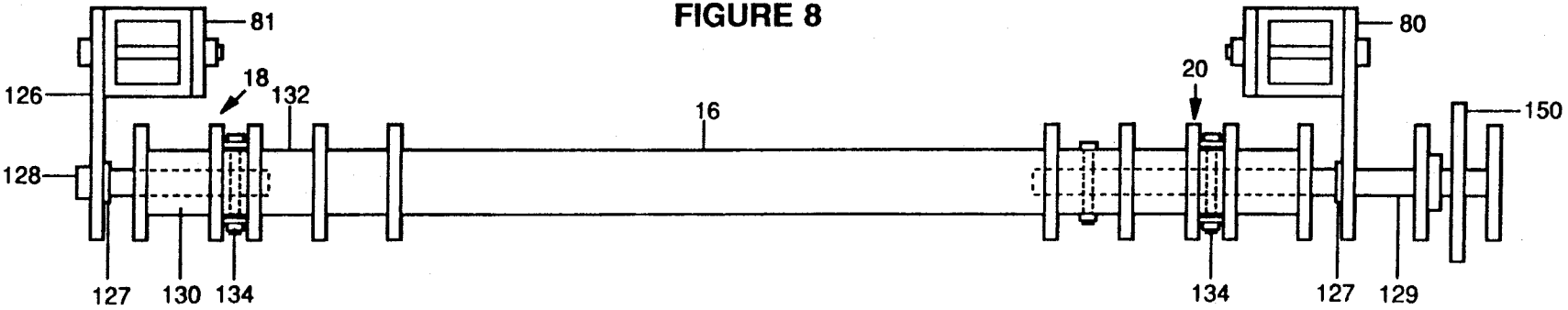
FIG. 8 is a front elevation view of the cable drive axle.
Figure 6:
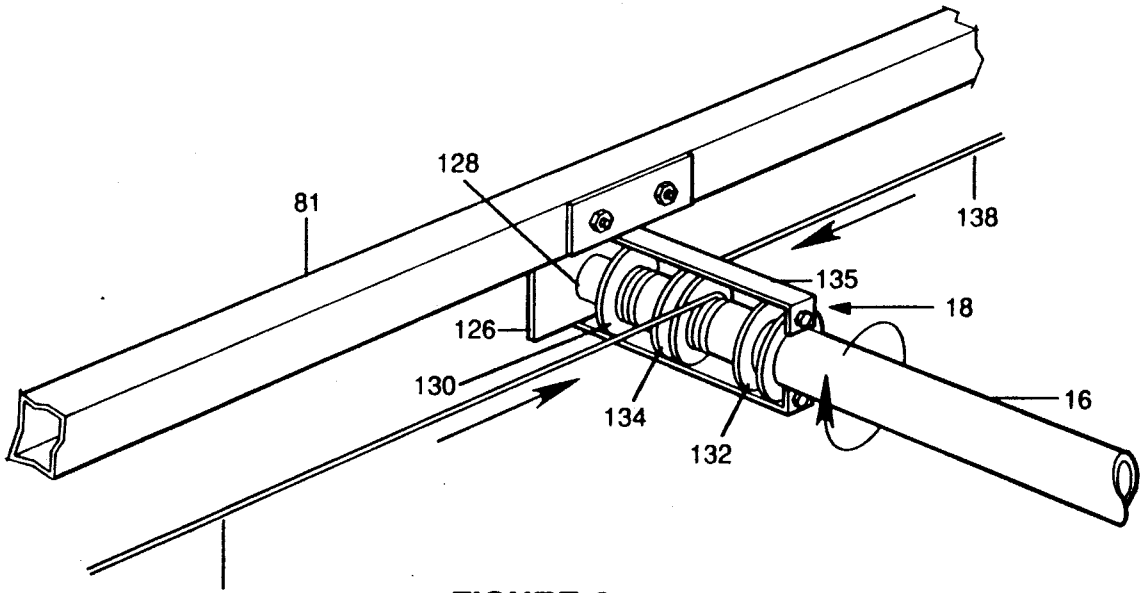
FIG. 6 is a partial perspective drawing of one end of the cable lift axle.
Figure 7:
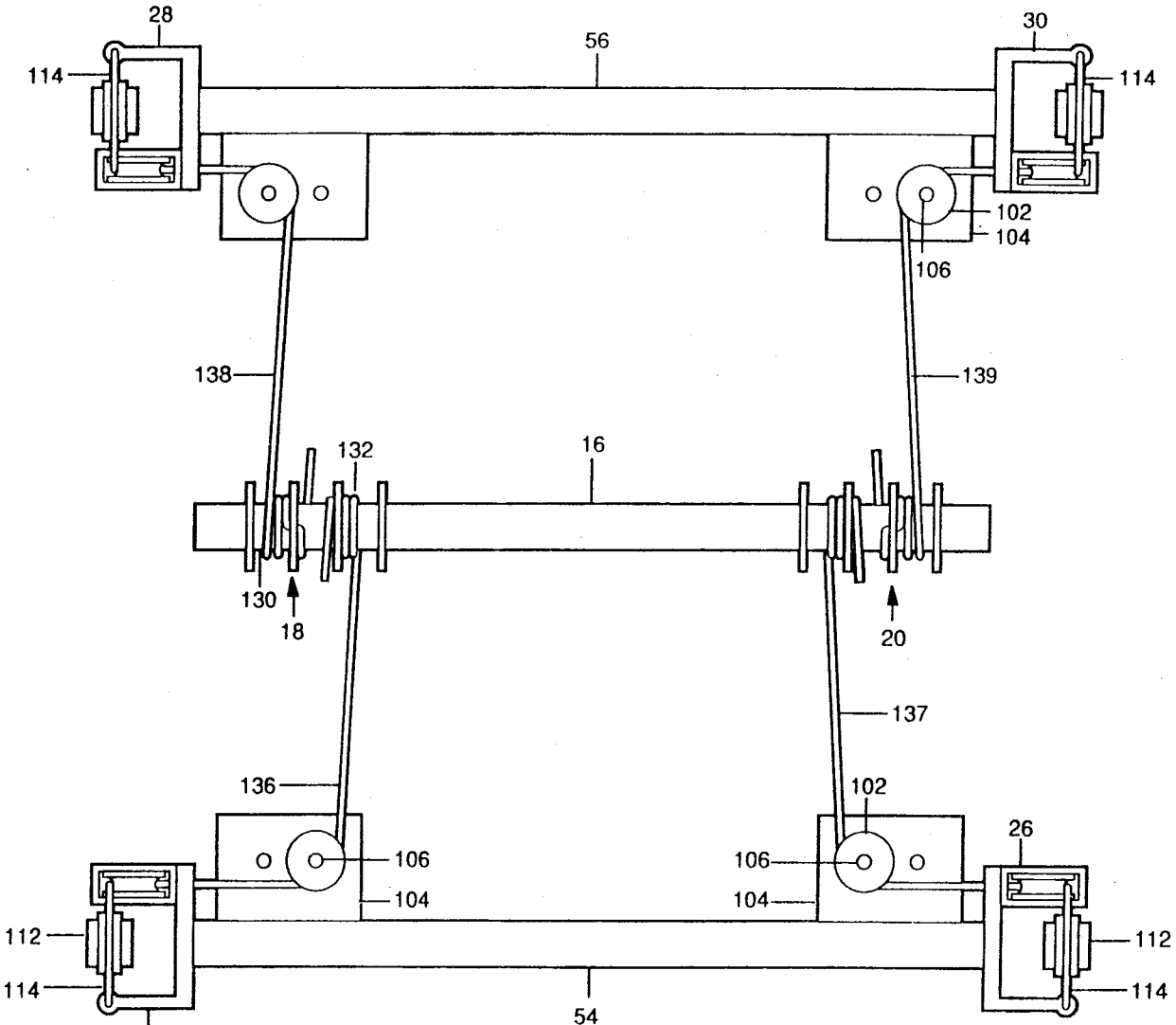
FIG. 7 is a top plan view of the cable routing between the cable drums and lift columns.

Returning attention to FIG. 5 and with further attention to FIGS. 6, 7 and 8, the lift axle 16 is rotatively supported midway along and between the longitudinal cradle members 80, 81. End brackets 126 and stub shafts 128, 129 contain the axle 16 to the members 80, 81. The stub shafts 128, 129 are secured to the axle 16 and are supported from bearings 127. Secured to the left and right ends of the axle 16 are the left and right cable take up drum assemblies 18, 20. The left assembly 18 is particularly shown at FIG. 6, but each assembly is essentially identical to the other (reference FIGS. 7 and 8).

Each assembly 18, 20 contains a pair of adjacent cable take-up spools 130, 132. Positioned between the spools 130, 132 is a covered clamp assembly 134 which contains bolted clamp plates for restraining the ends of cable pairs 136, 138 and 137, 139 which extend from the assemblies 18, 20. A guide plate 135 prevents the cables from crossing between the spools 130, 132. The cables 136–139 are trained about the pairs of horizontal and vertical transition pulleys 102, 100 of each coupler assembly 78 before being passed over the lift column pulleys 114 and terminating at the eyelets 94. A loop 139 is particularly formed in the cable at each eyelet 94 with the aid of a compression fitting 140. Proper synchronization of cradle movement is obtained by appropriately adjusting the wrap direction of the cable at the spools 130, 132 and the length of each of the pairs of cable segments 136, 138 and 137, 139 relative to the cable clamp assemblies 134.

FIG. 7 particularly depicts the four separate lengths of cable 136–139 which are adjustably secured to the axle 16 at the cable drum assemblies 18, 20. The cables 136–139 can be secured to either of the left or right spools 130, 132, provided a proper winding orientation is maintained. The cables are otherwise trained about the pulleys 102, 100 and 114 relative to the lift columns 24, 26, 28 and 30. Depending upon the direction of rotation at the axle 16, the cables are collected or released from the drums 18, 20 to raise or lower the cradle 8.

Figure 9:
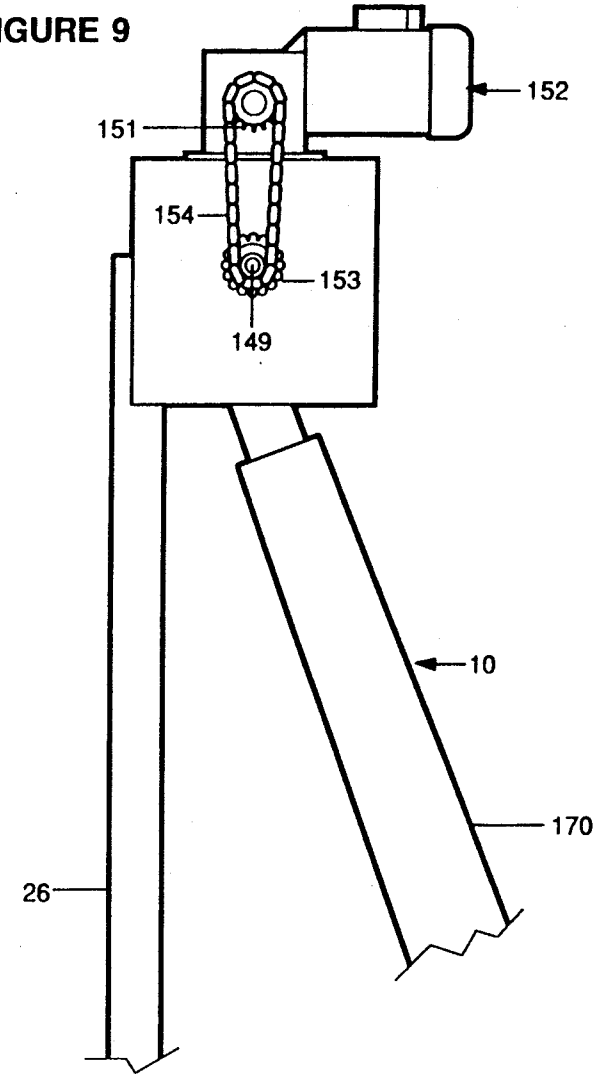
FIG. 9 is an elevation drawing of a remotely powered winch coupled to the articulating drive arm assembly.

Returning attention to FIGS. 3 and 4, the drive action to the axle 16 is obtained via the articulating drive or lift arm assembly 10 which couples the handwheel 9 to an end sprocket 150 secured to the stub shaft 129 and axle 16. Although a relatively large diameter handwheel 9 is shown for driving the assembly 10, it is to be appreciated that an AC powered, winch assembly 152 (reference FIG. 9) can alternatively be used to provide rotary drive power to a short coupler chain 154 connected between an input axle 149 and a pair of sprockets 151, 153. The sprocket 153 is added to the shaft 149 with the installation of the motorized winch assembly 152.

The handwheel 9, otherwise, is rotatively secured to the lift column 26 at an input axle 149 having a contained sprocket 155. A transfer chain 156 and sprockets 155, 157 couple the input axle 149 to a first drive axle 158 of the drive arm assembly 10. A ratchet wheel 159 secured to the input shaft 149 is mounted to rotate clockwise or counterclockwise, depending upon the position of a ratchet pawl 160 which engages the wheel 159. A brake assembly 161 also engages the front and rear surfaces of the wheel 159.

The drive chain 12 extends from the axle 158 and a drive sprocket 162, that is secured to the axle 158, to a sprocket 163 mounted to an intermediate axle 166. A first articulating, frame arm assembly 164 projects downward from the axle 158 and contains the chain 12 and axle 166. A chain tightener 168 is supported from the assembly 164 and a safety cover or shroud 170 surrounds the assembly 164.

A second articulating frame arm assembly 172 extends between the end of the arm assembly 164 and the cable axle 16. The intermediate axle 166 couples the articulating frame arm assemblies 164, 172 to one another. Also mounted to the axle 166 is a transfer sprocket 174 which in combination with the sprocket 150 supports the chain 14. A second chain tightener 168 is supported from the assembly 172, along with a separate safety shroud 176. The frame arm assemblies 164, 172 are thus free to pivot about the axles 129, 158 and 166 as they support the drive chains 12, 14 and articulate with the movement of the cradle 8 (reference FIGS. 1 and 2). Drive power to the axle 16 is simultaneously obtained from the transfer chain 156 and the drive chains 12, 14.

The ratios between the sprocket pairs 155, 157; 162, 163; and 174, 150 provide a lift advantage in the range of 10:1 to 20:1. This advantage is multiplied by the mechanical advantage obtained from the lift pulleys 114 to provide an overall advantage in the range of 128:1 to 320:1. A specific lift advantage relative to the load weight can be obtained, for example, by adjusting the sprocket sizes, adding additional pulleys etc..

The presently obtained lift advantage necessitates a relatively small physical exertion which can be provided from a single hand to rotate the handwheel 9. An elevational change of approximately 3/16 to ⅜ inches is obtained with each rotation of the wheel 9. Taken with the capabilities of the lift arm 10 and the hinged support frameworks 40, 42 to follow cradle movement, the assembly 2 provides a boat lift which finds particular advantage for use with medium size boats and waterways subject to wide fluctuations in water level.

Although the present invention has been described with respect to one presently considered construction and considered modifications and improvements thereto, it is to be appreciated that still other constructions may be suggested to those skilled in the art. The invention should accordingly be interpreted to include all those equivalent embodiments within the spirit and scope of the following claims.

What is claimed is:

1. Boat lift apparatus comprising:

a) a base framework comprised of a plurality of interconnected frame members and including a plurality of upright columns, wherein each of said columns includes a pulley rotatively mounted to an upper end;

b) cradle means for supporting a boat between said columns;

c) means for raising and lowering said cradle means including 1) an axle rotatively mounted to said cradle means, 2) a plurality of cables, and 3) spool means coupled to said axle for containing one end of each of said plurality of cables and wherein the other end of each of said cables is trained about a respective one of the column pulleys and anchored to a respective one of said columns; and d) drive means for rotating the cradle means axle including first and second chain support frames, means for pivotally coupling said first chain support frame to a first axle on one of said columns and said second chain support frame to the cradle means axle, endless chain means coupling said first axle and cradle means axle to one another and to a rotary drive means, whereby upon rotation of said rotary drive means said cradle means is raised or lowered and said first and second chain support frames and chain means pivot to follow cradle means movement.

2. Apparatus as set forth in claim 1 wherein said cradle means comprises a rectangular framework having fore and aft cross frame members and wherein said cradle means framework includes bracket means at each corner for supporting first and second support rollers in contact with first and second surfaces of each of said upright columns as the cradle means framework moves.

3. Apparatus as set forth in claim 2 wherein end portions of each of said fore and aft cross frame members extend along a surface of one of said upright columns to constrain the cradle means framework to the base framework without longitudinal swaying.

4. Apparatus as set forth in claim 3 wherein said bracket means includes a plurality of pulleys whereabout each cable is trained and directed from a horizontal to a vertical orientation on each of said columns.

5. Apparatus as set forth in claim 2 wherein said base framework includes first and second hinge means and each hinge means includes a pair of hinge portions pivotally coupled to each other and between said base framework and one of the fore and aft cross frame members.

6. Apparatus as set forth in claim 5 wherein said hinge portions comprise first and second H-shaped frames and one hinge portion includes a pair of projecting link arms which pivotally couple to the other hinge portion.

7. Apparatus as set forth in claim 1 wherein said rotary drive means comprises a handwheel and means including a ratchet wheel and pawl for coupling said handwheel in clockwise and counterclockwise rotational relation to said first axle.

8. Apparatus as set forth in claim 7 wherein said endless chain means includes a transfer chain coupled between said handwheel and said first axle and first and second chains supported on the respective first and second chain support frames.

9. Apparatus as set forth in claim 8 wherein said endless chain means includes means for varying the tension of said first and second chains.

10. Apparatus as set forth in claim 9 including means for securing a plurality of shroud covers to said first and second chain support frames.

11. Apparatus as set forth in claim 1 including means coupled to said base framework for elevationally leveling the base framework on a resting surface.

12. Apparatus as set forth in claim 11 wherein each of said columns includes coupler means for supporting a canopy means.

13. Boat lift apparatus comprising:

a) a base framework having a plurality of interconnected frame members and including a plurality of vertical columns;

b) cradle means including a plurality of rollers cooperating with multiple surfaces of each column for supporting a boat between said vertical columns;

c) means for raising and lowering said cradle means including an axle rotatively mounted to said cradle means and a plurality of pulleys and cables, wherein each cable is coupled at one end to said axle and trained about a respective pulley secured to an upper portion of each of said columns; and d) drive means for rotating the cradle means axle to raise and lower said cradle means including first and second support frames and first and second endless chains respectively secured to said first and second support frame and means for pivotally coupling said first and second support frames to one another and between one of said columns and the cradle means axle, whereby said drive means articulates to follow cradle means movement.

14. Apparatus as set forth in claim 13 wherein said base framework includes first and second hinge means and each hinge means includes a pair of hinge portions pivotally coupled to each other and between said base framework and one of the fore and aft cross frame members for supporting the cradle means.

15. Apparatus as set forth in claim 14 wherein said drive means includes a transfer chain coupled between a handwheel and an axle mounted on said first support frame.

16. Apparatus as set forth in claim 15 including means coupled to said base framework for elevationally leveling the base framework on a resting surface.

17. Apparatus as set forth in claim 13 wherein each of said columns includes a pair of pulleys, wherein said cradle means includes a pulley mounted adjacent each of said columns, and wherein each of said cables is trained about the pulleys of a respective on of said columns and an adjacent cradle means pulley and anchored to the one of said columns.

18. Apparatus as set forth in claim 13 wherein said cradle means includes means for directing each of said cables from a horizontal alignment with the cradle means to a vertical alignment with each of said columns.

19. Drive means for a boat lift including a cradle framework suspended from a base framework, comprising:

a) first and second chain support frameworks pivotally coupled to one another at a first axle, wherein said first chain support framework is pivotally coupled to the base framework at a second axle and said second chain support framework is pivotally coupled to a third axle rotatively supported on the cradle framework;

b) a first endless chain coupled between said first and second axles and a second endless chain coupled between said first and third axles; and c) means for rotatively driving said second axle, whereby said first and second chain support frameworks articulate to follow vertical movement of the cradle framework.

20. Apparatus as set forth in claim 19 including means for varying the tension of said first and second chains.

21. Apparatus as set forth in claim 19 wherein the rotary drive means comprises winch means including a transfer chain coupled to said second axle.

* * * * *